US007830339B2

(12) United States Patent
Yui

(10) Patent No.: US 7,830,339 B2
(45) Date of Patent: Nov. 9, 2010

(54) IMAGE DISPLAY APPARATUS

(75) Inventor: Hideaki Yui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 977 days.

(21) Appl. No.: 11/275,174

(22) Filed: Dec. 16, 2005

(65) Prior Publication Data

US 2006/0132396 A1 Jun. 22, 2006

(30) Foreign Application Priority Data

Dec. 17, 2004 (JP) ..... 2004-365533
Dec. 13, 2005 (JP) ..... 2005-358829

(51) Int. Cl.
*G09G 3/20* (2006.01)
*G09G 3/22* (2006.01)

(52) U.S. Cl. ..... 345/75.2; 345/74.1

(58) Field of Classification Search ..... 345/58, 345/63, 76, 103

See application file for complete search history.

(56) References Cited

U.S. PATENT DOCUMENTS

| | | | | |
|---|---|---|---|---|
| 5,654,607 | A | 8/1997 | Yamaguchi et al. | 313/495 |
| 5,677,741 | A | 10/1997 | Yui | 348/649 |
| 5,734,361 | A | 3/1998 | Suzuki et al. | 345/74 |
| 5,815,135 | A | 9/1998 | Yui et al. | 345/97 |
| 5,912,713 | A | 6/1999 | Tsunoda et al. | 348/540 |
| 6,307,327 | B1 * | 10/2001 | Xie et al. | 315/169.4 |
| 6,329,759 | B1 | 12/2001 | Tanaka et al. | 315/169.3 |
| 6,473,088 | B1 | 10/2002 | Matsumoto et al. | 345/530 |
| 6,538,675 | B2 | 3/2003 | Aratani et al. | 345/856 |
| 6,614,439 | B2 | 9/2003 | Matsumoto et al. | 345/530 |
| 6,870,522 | B2 | 3/2005 | Sagano et al. | 345/75.2 |
| 6,995,791 | B2 * | 2/2006 | Skow | 348/223.1 |
| 7,046,219 | B2 | 5/2006 | Kanai et al. | 345/75.2 |
| 7,148,909 | B2 | 12/2006 | Yui et al. | 345/660 |
| 7,230,386 | B2 | 6/2007 | Yui et al. | 315/85 |
| 7,327,506 | B2 | 2/2008 | Yui | 358/527 |

(Continued)

FOREIGN PATENT DOCUMENTS

JP 2-055492 2/1990

(Continued)

*Primary Examiner*—Kevin M Nguyen
(74) *Attorney, Agent, or Firm*—Fitzpatrick, Cella, Harper & Scinto

(57) ABSTRACT

An image display apparatus includes a rear plate having electron-emitting devices, a face plate having light-emitting regions, a spacer arranged between the rear plate and the face plate, and a drive circuit having a correction circuit which corrects input image data. A quantity of light emitted from an object light-emitting region depends on the quantity of electrons coming from a corresponding object electron-emitting device and coming from peripheral light-emitting regions of the object light-emitting region, and the quantity of light emitted from the object light-emitting region decreases when at least some of the emitted electrons are blocked by the spacer. The correction circuit includes a first circuit that calculates a value equivalent to the decrease in the quantity of light emitted from the object light-emitting region due to the blocked electrons, a second circuit that calculates a correction value by multiplying the value equivalent to the decrease in the quantity of light by an adjustment gain value that complies with a color of the object light-emitting region, and a third circuit that adds the correction value to the input image data of the object electron-emitting device.

8 Claims, 9 Drawing Sheets

U.S. PATENT DOCUMENTS

| | | | | |
|---|---|---|---|---|
| 2002/0171608 | A1* | 11/2002 | Kanai et al. | 345/55 |
| 2003/0107542 | A1* | 6/2003 | Abe et al. | 345/89 |
| 2005/0206958 | A1 | 9/2005 | Inamura | 358/3.23 |
| 2005/0285543 | A1 | 12/2005 | Yui et al. | 315/169.4 |
| 2005/0286062 | A1 | 12/2005 | Yui | 358/1.9 |
| 2006/0125731 | A1 | 6/2006 | Yui | 345/75.2 |
| 2006/0132394 | A1 | 6/2006 | Hayama et al. | 345/74.1 |
| 2006/0192493 | A1 | 8/2006 | Kanai et al. | 315/161 |
| 2007/0188526 | A1 | 8/2007 | Yui et al. | 345/690 |

FOREIGN PATENT DOCUMENTS

| | | |
|---|---|---|
| JP | 7-005836 | 1/1995 |
| JP | 2000-242214 | 9/2000 |
| JP | 2000-250463 | 9/2000 |
| JP | 2005-031636 | 2/2005 |
| JP | 2005-301218 | 10/2005 |
| JP | 2006-047989 | 2/2006 |
| JP | 03870210 | 1/2007 |
| JP | 03870214 | 1/2007 |
| JP | 03962728 | 8/2007 |

* cited by examiner

DISPLAY BEFORE CORRECTION

RA: REGION NOT IN THE VICINITY OF SPACER
RB: REGION IN THE VICINITY OF SPACER

DISPLAY AFTER CORRECTION

RA: REGION NOT IN THE VICINITY OF SPACER
RB: REGION IN THE VICINITY OF SPACER

FIG. 9

| LIGHTED COLOR | R ADJUSTMENT GAIN VALUE | G ADJUSTMENT GAIN VALUE | B ADJUSTMENT GAIN VALUE |
|---|---|---|---|
| R | 1.0 | 1.1 | 1.0 |
| G | 1.0 | 1.0 | 1.0 |
| B | 1.0 | 1.4 | 1.0 |
| Ye | 1.0 | 1.0 | 1.0 |
| Cy | 1.0 | 1.0 | 1.0 |
| Mg | 1.0 | 1.0 | 1.0 |
| W | 1.0 | 1.0 | 1.0 |

IMAGE DISPLAY APPARATUS

BACKGROUND OF THE INVENTION

1. Field of the Invention

The present invention relates to an image display apparatus.

2. Description of the Related Art

In U.S. Pat. No. 6,307,327, as a method for controlling spacer visibility in a field emission display, a pixel data correction method is described. Defining a first region in the vicinity of a spacer and a second region not in the vicinity of the spacer, this method modifies pixel data to be transferred to the first region according to an intensity level of light generated by a plurality of pixels of the first region in the vicinity of the spacer, in order to prevent a viewer from viewing the spacer.

SUMMARY OF THE INVENTION

It is an object of the present invention to improve correction performance in an image display apparatus.

According to a first aspect of the present invention, there is provided an image display apparatus comprising:

a plurality of display devices respectively having correlated light emitting regions and causing the light emitting regions to emit light so as to display an image comprised of a plurality of colors;

a plurality of members arranged at a distance of a plurality of the display devices from each other; and a drive circuit for outputting drive signals that correspond to the colors respectively and drive the display devices, based on input image data, the drive circuit having a correction circuit for outputting the corrected drives signals, wherein the correction circuit has:

a calculation circuit for calculating a value that compensates for an "amount that is reduced by the member" from a "change in quantity of light emitted from a predetermined one of the light emitting regions according to the input image data, the change being caused by driving of the display device having any of the light emitting regions other than the predetermined light emitting region"; and an adjustment circuit for adjusting the value calculated by the calculation circuit by using an adjustment value that complies with a color to which the drive signal corresponds.

A "display device" as used herein is comprised of an electron-emitting device and a light emitter such as a fluorescent material that emits light when irradiated with electron emitted from this electron-emitting device in an electron beam display apparatus that uses the electron-emitting device such as a surface conduction electron-emitting device or a field emission element. In this case, a spacer functions as the above-described "member". Further, the present invention can be applied also to a plasma display apparatus. In this case, a discharge cell corresponds to the "display device" and a barrier rib that separates the discharge cells corresponds to the "member".

It is preferred that the adjustment circuit adjusts the value calculated by the calculation circuit and outputs the adjusted value as a correction value; and the correction circuit has a correction value addition circuit for adding the correction value to image data to be corrected.

It is preferred that the adjustment value is determined according to a value of the input image data.

It is preferred that the display devices each have an electron-emitting device and a light emitting region which is arranged at a distance from the electron-emitting device and which emits light when irradiated with the electrons emitted from the electron-emitting device;

the member is an electronic blockading member for blockading electrons due to the electrons emitted from a second electron-emitting device positioned in the vicinity of a first electron-emitting device corresponding to a first light emitting region to thereby inhibit the first light emitting region form being irradiated with the electrons due to the electrons emitted from the second electron-emitting device; and the value calculated by the calculation circuit corresponds to a blockaded quantity, owing to the electron blockading member, of electrons emitted from the second electron-emitting device with which the first light emitting region is irradiated.

According to a second aspect of the present invention, there is provided an image display apparatus comprising:

a plurality of display devices respectively having correlated light emitting regions and causing the light emitting regions to emit light so as to display an image comprised of a plurality of colors; and a drive circuit for outputting drive signals that corresponds to the colors respectively and drive the display devices, based on input image data, the drive circuit having a correction circuit for outputting the corrected drive signals, wherein the correction circuit has:

a calculation circuit for calculating a value that compensates for a "charge in quantity of light emitted from a predetermined one of the light emitting regions according to the input image data, the change being caused by driving of the display device having any of the light emitting regions other than the predetermined light emitting region"; and an adjustment circuit for adjusting the value calculated by the calculation circuit by using an adjustment value that complies with a color to which the drive signal corresponds.

According to the present invention, it is possible to provide an image display apparatus having improved correction performance.

BRIEF DESCRIPTION OF THE DRAWINGS

FIG. 9 is a correspondence table showing a color-specific adjustment ratio of a correction quantity for each of generated colors.

DESCRIPTION OF THE PREFERRED EMBODIMENTS

First Embodiment

The following will describe in detail the first embodiment of the present invention.

The present invention can be applied to a display apparatus using a surface conduction electron-emitting device, a field emission display apparatus (FED), a plasma display apparatus (PDP), etc. In an electron beam display apparatus such as an FED or a display apparatus that uses a surface conduction electron-emitting device, there is a possibility that halation may be caused on a peripheral pixel by brightness of a luminescent spot that has self-emitted. Therefore the electron beam display apparatus is a preferable embodiment which the present invention may be applied to. The plasma display apparatus is another preferable embodiment to which the present invention may be applied, because there is a possibility of halation (cross-talk) occurring onto a peripheral pixel similarly if there is no barrier rib between discharge cells or if a structure of the barrier rib exceeds a unit pixel in size.

Figure 3:
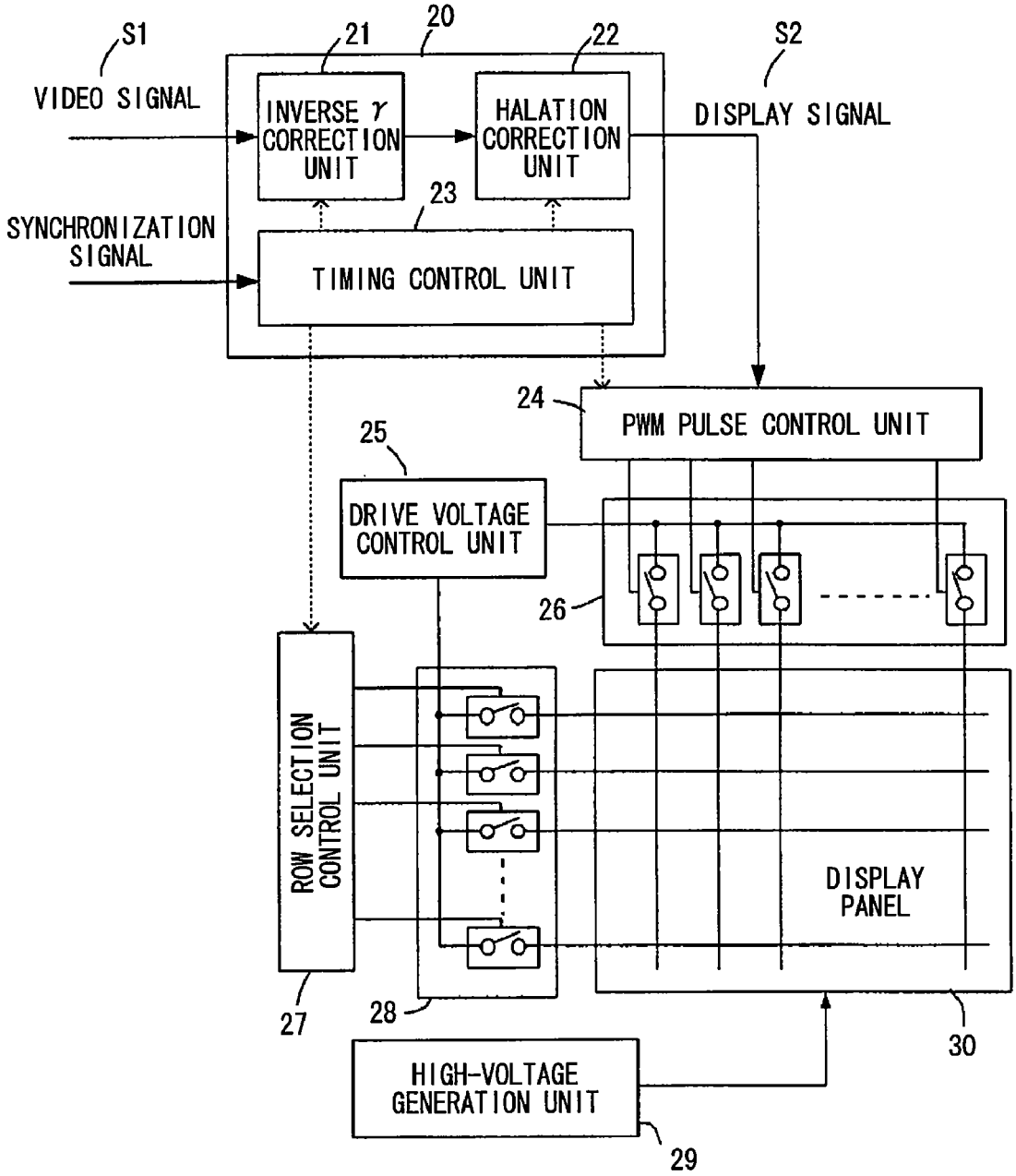
FIG. 3 is a block diagram of an image display apparatus related to the embodiment of the present invention.

First, a configuration of an image display apparatus of the present embodiment is described with reference to FIG. 3. Reference numeral 30 denotes a display panel. The display panel 30 comprises a multi-electron source in which a plurality of electron-emitting devices (for example, cold cathode devices) is arrayed on a substrate and an image forming member (for example, fluorescent material) for forming (displaying) an image when irradiated with electrons, the multi-electron source and the image forming member being arranged opposite each other in a thin vacuum vessel. The electron-emitting devices are wired in a simple matrix by using row-directional wiring electrodes and column-directional wiring electrodes, so that electrons are emitted from the device selected by column electrode/row electrode biases. By accelerating these electrons with a high voltage, these electrons collide with the fluorescent material and light is emitted. In the present embodiment, a surface conduction electron-emitting device is used as the electron-emitting device. A configuration and a manufacturing method of a display panel using the surface conduction electron-emitting device are disclosed in detail in Japanese Patent application laid-Open publication No. 2000-250463, which is hereby incorporated by reference.

The following will describe operations from a step of inputting a video signal to this display panel 30 to a step of displaying a video. A signal S1 indicates an input video signal. A signal processing unit 20 performs display-optimal processing on the input video signal S1 to output a display signal S2. In FIG. 3, as for functions of the signal processing unit 20, only such a function block is given as to be minimum required to describe the present embodiment. Reference numeral 21 denotes an inverse γ correction unit. Generally, the input video signal S1 is transmitted or recorded after being subjected to nonlinear transformation such as the 0.45'th power referred to as gamma transformation that matches input vs. light emission characteristics of a CRT display on the assumption that an video due to the input video signal S1 is displayed on the CRT display apparatus. To display the video due to the video signal on a display apparatus that uses a surface conduction electron-emitting device or a display device having linear input vs. light emission characteristics such as an FED or a PDP, it is necessary to perform inverse gamma transformation such as the 2.2'th power on the input signal. Output data of the inverse γ correction unit 21 has been transformed in such a manner as to provide a linear relationship between brightness of the display panel 30 and the data. The output data is input to a halation correction unit 22. The halation correction unit 22 is described in detail later. From the halation correction unit 22, a display signal S2 is output which displays a video optimal to the display panel 30. A timing control unit 23 generates and outputs a variety of timing signals for operations of the blocks, based on a synchronization signal handed over together with the input video signal S1.

A PWM pulse control unit 24 transforms (Pulse Width Modulation (PWM) in the present embodiment) the display signal S2 into a drive signal adapted to the display panel 30 for each horizontal cycle (row selection period). A drive voltage control unit 25 controls a voltage that drives the devices arranged on the display panel 30. A column wiring switch unit 26, which is comprised of switch means such as a transistor, applies for each horizontal cycle (row selection period) a driving voltage from the drive voltage control unit 25 to the column electrode on the panel only when a PWM pulse is output from the PWM pulse control unit 24. A row selection control unit 27 generates a row selection pulse that drives the devices on the display panel 30. A row wiring switch unit 28, which is comprised of switch means such as a transistor, provides to the display panel 30 an output of the drive voltage control unit 25 according to a row function pulse output from the row selection control unit 27. A high-voltage generation unit 29 generates an acceleration voltage that accelerates electrons emitted from the electron-emitting device arranged on the display panel 30 so that the electrons may collide with the fluorescent material (not shown). In such a manner, the display panel 30 is driven to display the video.

It is to be noted that in the present embodiment, a drive circuit of the present invention is comprised of the signal processing unit 20, the PWM pulse control unit 24, the drive voltage control unit 25, the column wiring switch unit 26, the row selection control unit 27, and the row wiring switch unit 28. Further, a correction circuit of the present invention is comprised of halation correction unit 22.

Next, the halation correction unit 22 is described with reference to FIG. 1.

Before description with reference to FIG. 1, what is halation is explained below.

Figure 4A:
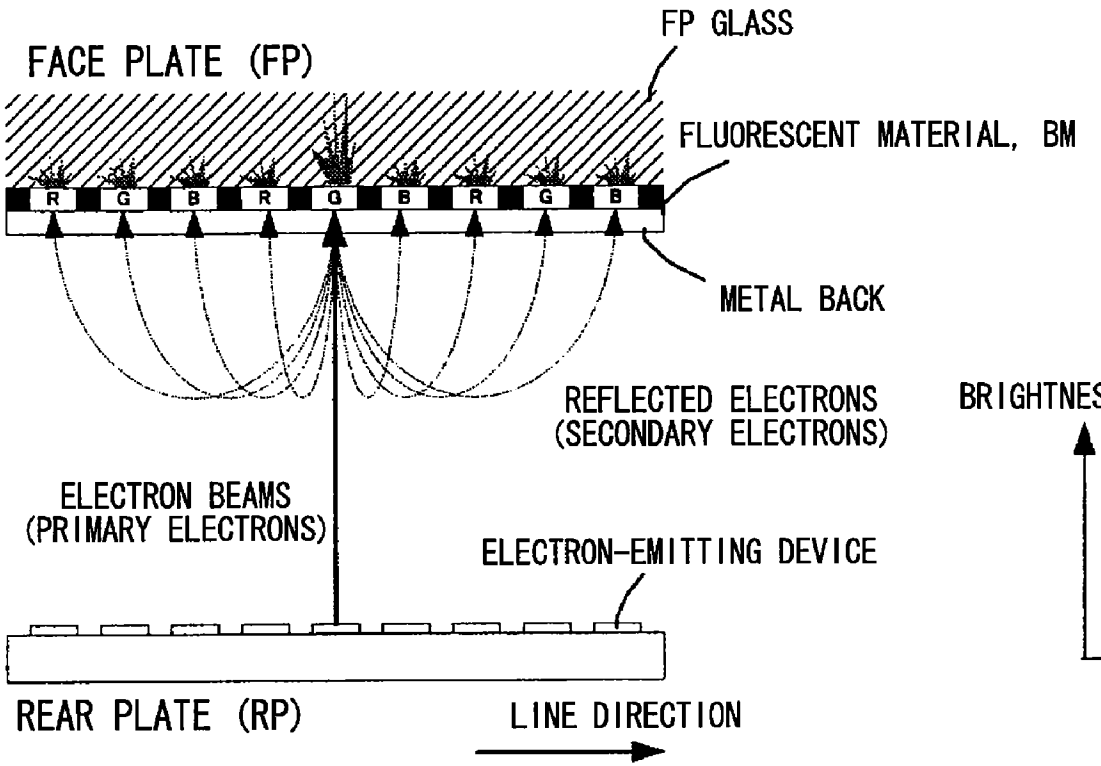
FIGS. 4A and 4B are explanatory diagrams of a mechanism of occurrence of halation not in the vicinity of a spacer.
Figure 4B:
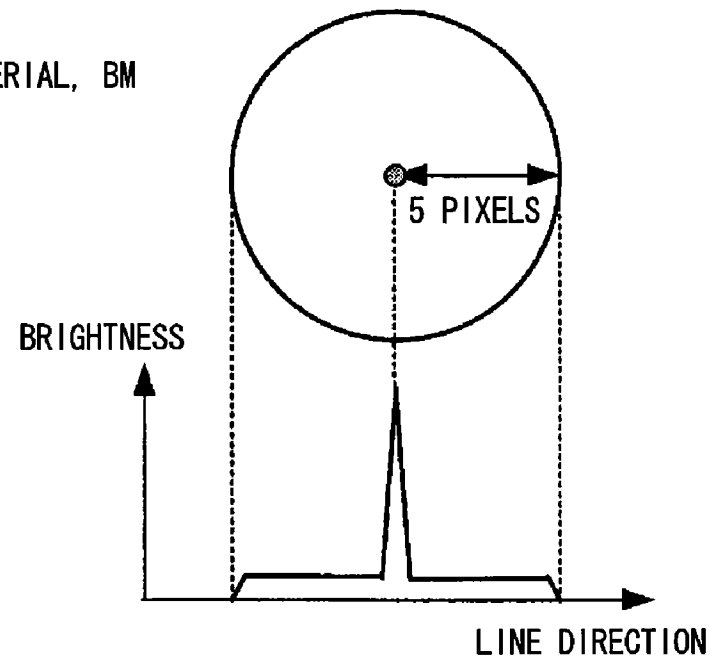
Figure 6:
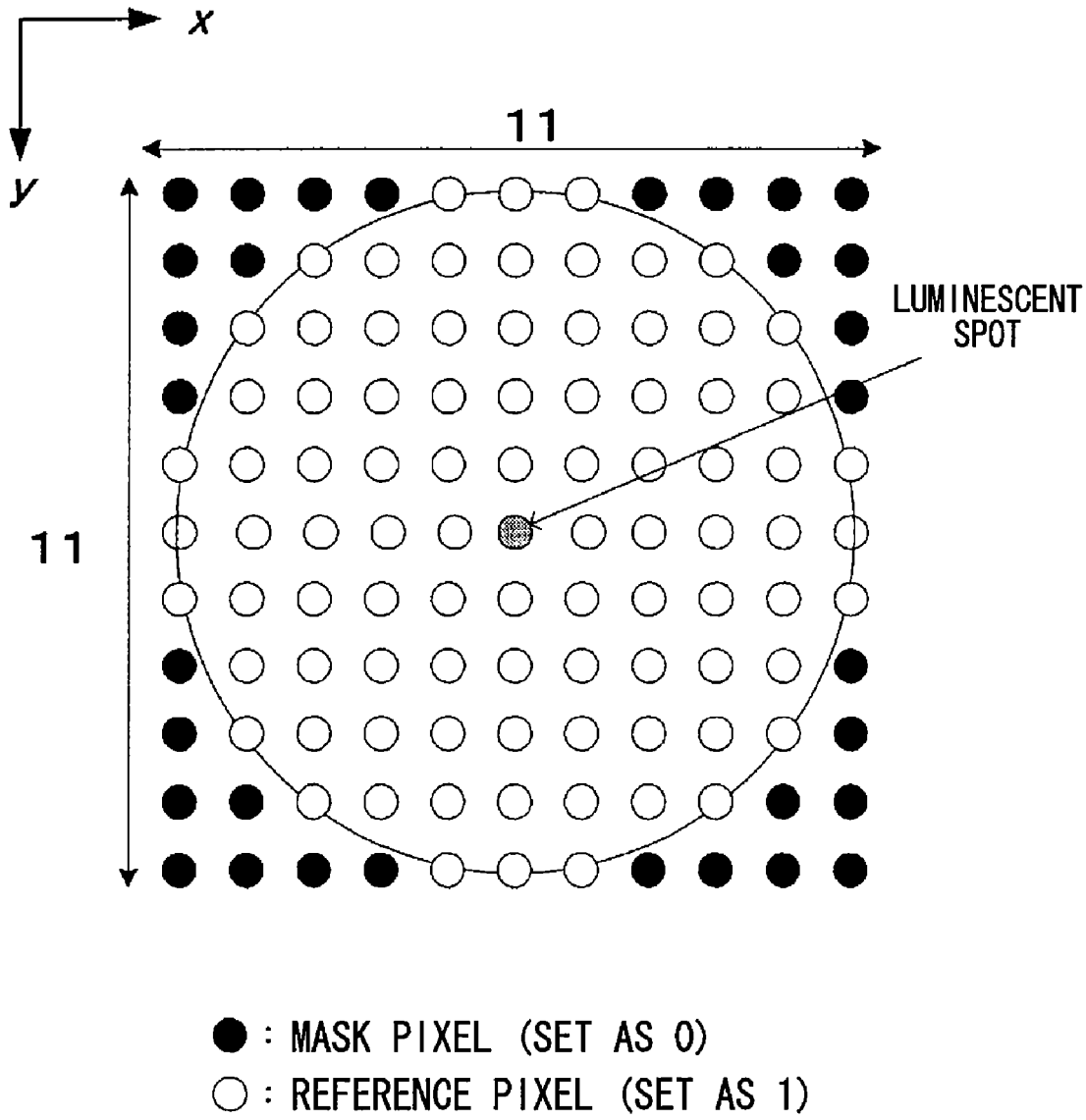
FIG. 6 is a halation mask pattern diagram having 11 pixels× 11 pixels.

FIG. 4A shows an image display apparatus for using electron-emitting devices formed on a rear plate and light emitters (red, blue, and green fluorescent materials in the present embodiment) arranged on a face plate having space with the electron-emitting devices, to irradiate these light emitters with electron beams (primary electrons) emitted from the electron-emitting devices, thereby causing the light emitters to emit light. The present inventor has found such a problem peculiar to this type of image display apparatus that color reproducibility is different from a desired state. Specifically, for example, if only the blue fluorescent material is irradiated with electrons to emit blue color light, not pure blue color but light having a color slightly mixed with another color, that is, light in which green and red colors are mixed is emitted, with poor color saturation. The present inventor has studied hard and, as a result, found out the cause of the deterioration of the saturation. Primary electrons emitted from the electron-emitting device impinge on the light emitter that corresponds to this electron-emitting device so that this corresponding light emitter may emit light at its luminescent spot. But, these primary electrons are reflected by this light emitter and impinge on close (and adjacent) light-emitting regions of different colors as reflected electrons (secondary electrons) so that its peripheral light emitter may also emit light, thereby deteriorating the color saturation. A phenomenon that a display device emits light by an influence from the drive of adjacent display devices, such as light emission due to reflected electrons, is referred to as "halation" in the present specification. In a display apparatus using a surface conduction electron-emitting device, as shown in FIG. 4B, it was found that when a fluorescent material is irradiated with electrons, pixels around it emit light in a circle owing to halation (light emission is distributed in a cylinder around a luminescent spot if expressed in terms of brightness as a quantity of emitted light). If a radius of this circular region influences by halation is as long as n number of pixels, a filter as large as (2n+1) number of taps is required as pixel reference range for halation correction processing, as described in detail later. Furthermore, it was found that the radius of a region influenced by halation can be uniquely determined reasonably practically by a distance between the face plate on which the fluorescent material is arranged and the rear plate in which the electron source is arranged, a size of the pixels, etc. Therefor, if the distance between the face plate and the rear plate is known, the number of filter taps is determined uniquely. Since n is five (n=5) pixel in the present embodiment, it can be known that the number of filter taps is 11, that is, it is necessary to reference data of 11 pixels×11 lines as shown in FIG. 6 in order to accommodate an influence of halation. In such a manner, a radius of a region influenced by halation is a static parameter obtained from a physical structure (distance between the face plate and the rear plate, and pixel size) of the display panel, so that for compatibility of the correction circuit with a plurality of different display panels, such a halation mask pattern as shown in FIG. 6 may be changed as a variable parameter.

Figure 5B:
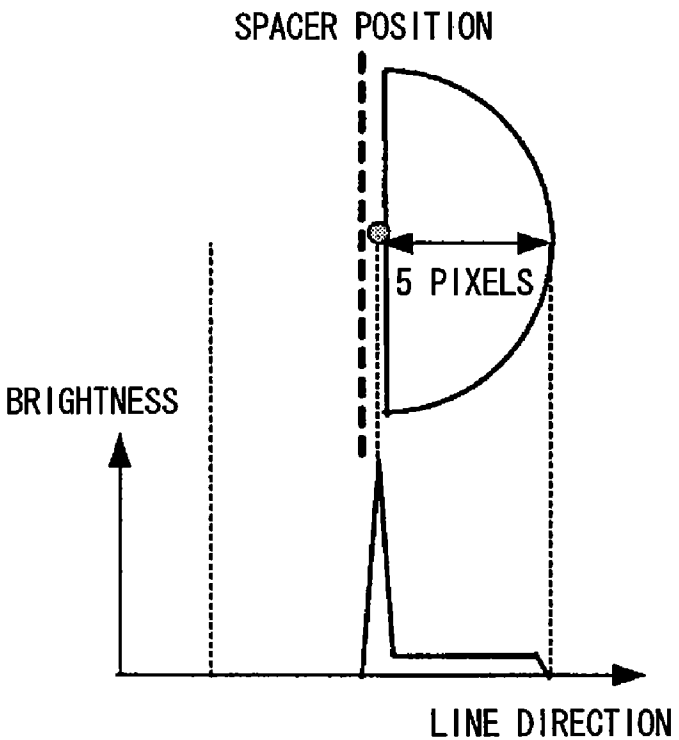
FIGS. 5A and 5B are explanatory diagrams of the mechanism of occurrence of halation in the vicinity of a spacer.
Figure 5A:
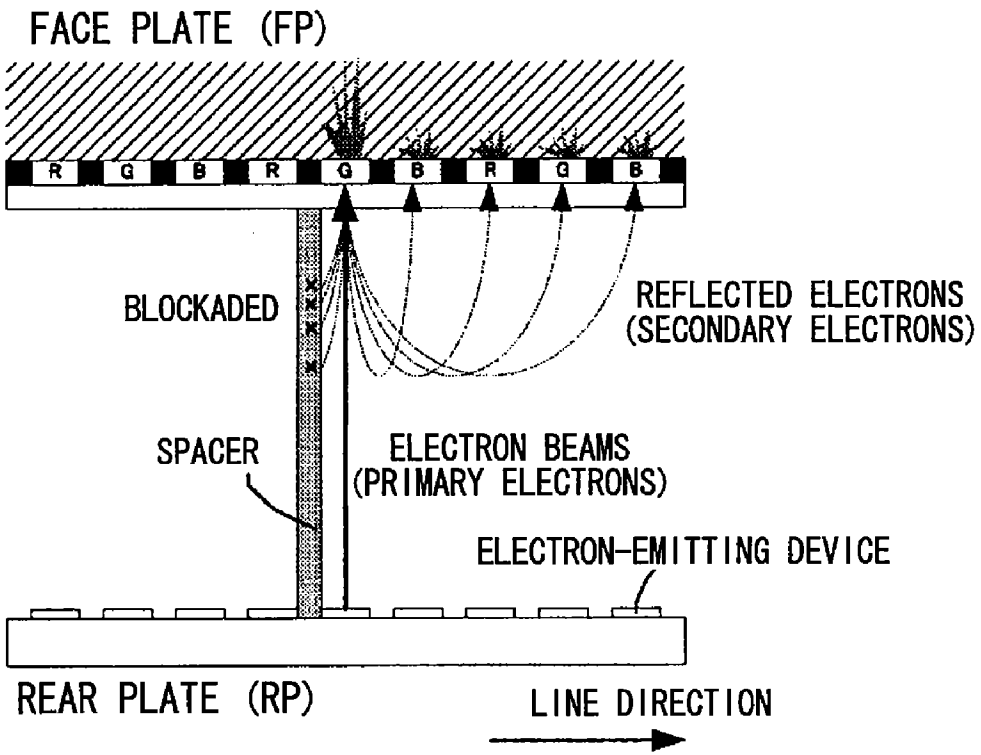

FIGS. 4A and 4B show a case where there is no blockading member such as a spacer (region not in the vicinity of a spacer) on a trajectory of reflected electrons. On the other hand, FIG. 5A shows a case where there is an electron blockading member such as spacer (region in the vicinity of a spacer), which spacer blockades reflected electrons (secondary electrons) so that a halation intensity diminishes. Therefore, in a case where electron beams (primary electrons) are emitted form the electron-emitting device closest to the spacer, it was found that halation has an influence on a semicircular light-emitting range as shown in FIG. 5B. (FIGS. 4A and 5A show "horizontal stripes" where fluorescent materials of R, G, and B are arranged alternately with each other in a line direction (vertically). However, they are shown for convenience of explanation, and the actual display panel employs a configuration of "vertical stripes" where the fluorescent materials of R, G, and B are arranged alternately with each other horizontally).

Figure 8A:
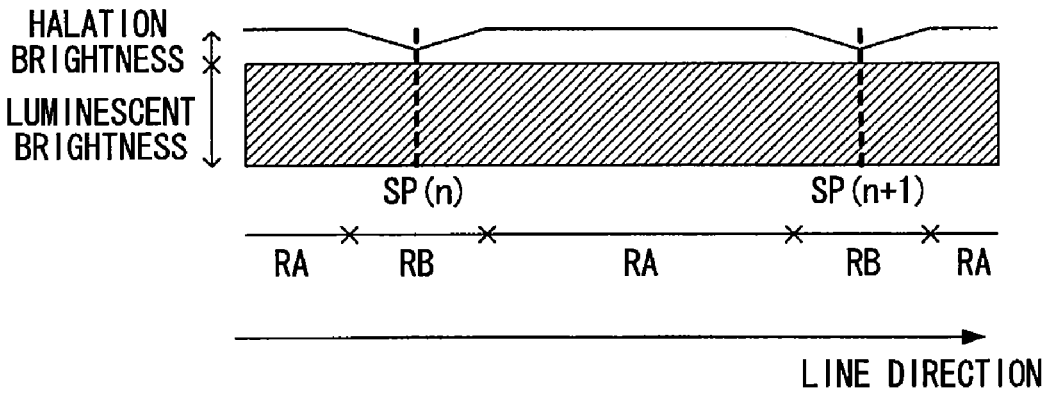
FIGS. 8A and 8B are image diagrams of halation correction by a blockaded quantity summation system.

These operations have been given to explain a halation occurring mechanism with reference to an example of one-device driving. In the display panel used in the present embodiment, a plurality of long spacers has been mounted at intervals (distance) of several tens of lines in a horizontal direction. Arranging the spacers so as to accommodate all of the lines increase the cost problematically. Therefore it is optimal to give spacing of at least 15 lines (15 devices) between the spacers. The spacers may have a variety of shapes. The present embodiment has employed a sheet-shaped spacer that is arranged along the horizontal line in the display panel and has the length corresponding to the width of the display panel. The present inventor has discussed a case where light of the same color is emitted all over the surface in such a configuration that the spacers are set up at an intervals of several devices. It was found that in this configuration, a quantity of halation is different between the above-described region in the vicinity of the spacer and the region not join the vicinity of the spacer. It was confirmed that the difference in quantity of halation causes an inherent problem that color purity varies in the vicinity of the spacer. This problem is referred to as spacer unevenness. A degree of spacer unevenness varies with a light emission pattern of displayed images. For example, when blue light is emitted all over the surface, halation brightness is added to brightness of the emitted blue light as shown in FIG. 8A. This halation brightness indicates a variation in light emitted from a predetermined light emitting region according to input image data, the variation caused by the drive of display devices in a light emitting region other than the predetermined light emitting region. A region in the vicinity of the spacer has a step-wise variation in blockaded quantity of reflected electrons depending on a distance from the spacer, so that a step-wise wedge-shaped variation having a width as large as about 10 lines is recognized visually in color purity. This wedge-shaped drop in brightness accounts for such a quantity of halation brightness as to be reduced by the spacer.

It is to be noted that brightness can be used as the quantity of light emitted from the predetermined light emitting region. However, it is desirable to take account of halation from devices of any horizontal lines other than a light emitting region of a predetermined horizontal line. Therefore, specifically, a integral of the brightness of this light emitting region over a predetermined period (one frame period, one vertical scanning period, etc.) may be employed as the quantity of light emitted from a predetermined light emitting region.

The present inventor studied hard to work out factors that may cause the above-described spacer unevenness and, as a result found a novel image display apparatus configuration and drive signal correction method that are able to improve an image quality of a display panel. The following will describe specific examples of the image display apparatus and the drive signal correction method with reference to FIG. 1.

A memory line 1 is comprised of 11 line memories in the present embodiment. Original image data is serially written to the line memory 1 in the unit of a line. When 11 lines of data is stored, 11 pixels×11 lines of data is read simultaneously for the purpose of reference in operation.

Figure 7:
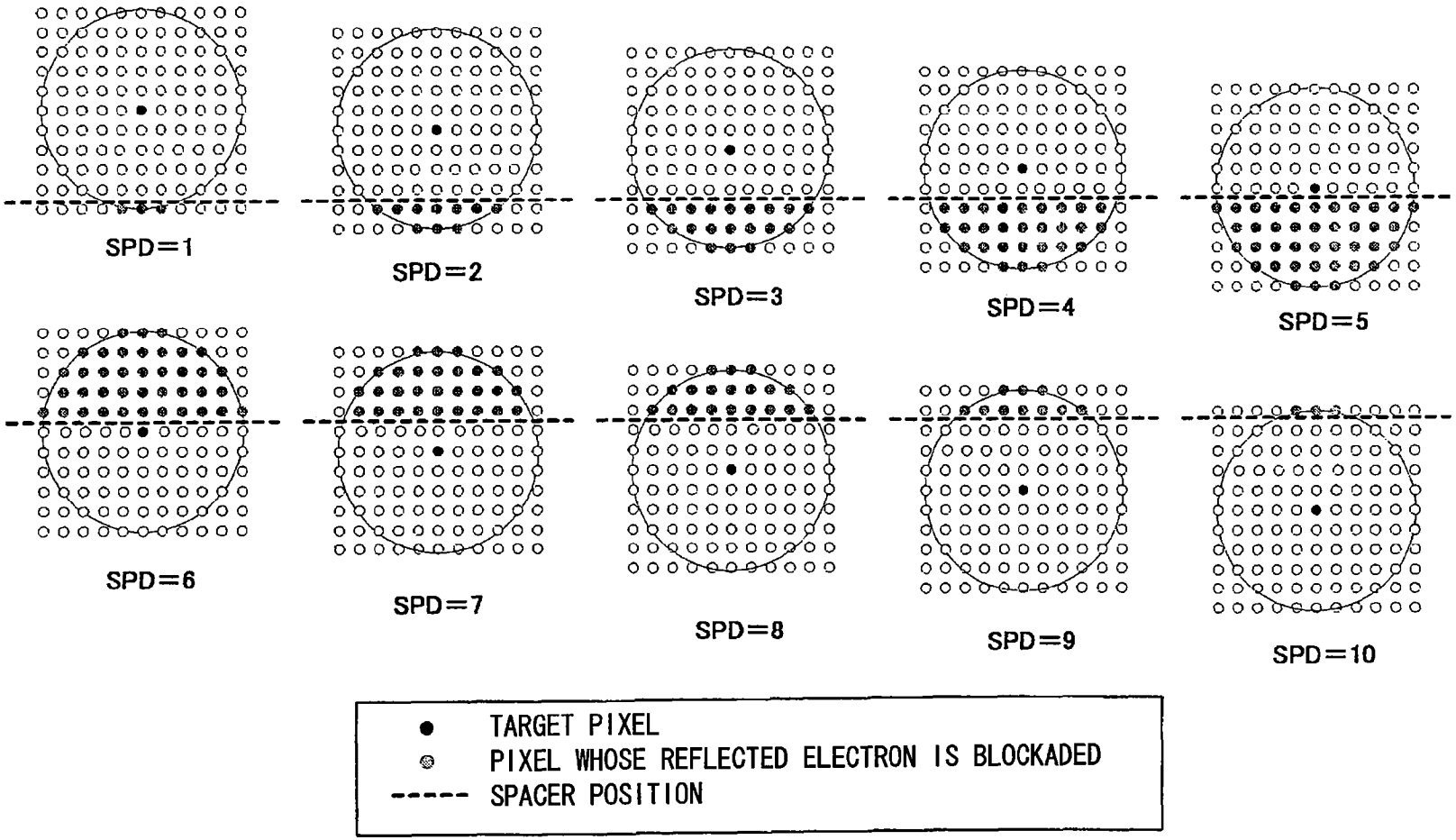
FIG. 7 is a correspondence diagram of pixel regions in which reflected electrons are blockaded according to a distance between a target pixel and the spacer.

The simultaneously read 11 pixels×11 lines of data pieces around a target pixel are referenced by a selective addition unit 2 for the purpose of operations. The data of the target pixel is transmitted to a correction addition unit 6. With respect to a target pixel on the vicinity of a spacer, the selective addition unit 2 selectively sums only those blockaded by the spacer of reflected electrons from pixels surrounding the target pixel. The selective addition unit 2 decides whether a target pixel is in the vicinity of the spacer or not in the vicinity of the spacer based on a Spacer Distance (SPD) value that indicated a positional relationship between the target pixel and the spacer that is generated by a spacer position information generation unit 3. The spacer position information generation unit 3 generates an SPD value from spacer position information and a timing control signal received from the timing control unit 23. As for the target pixel in the vicinity of the spacer, there are ten patterns of the pixel to which the reflected electrons can not reach because of blockade by the spacer as shown in FIG. 7. These patterns are each assigned an SPD value of 1 to 10. A total quantity of emitted light relating to blockaded quantity is obtained by selecting pixels shown in gray according to an SPD value and summing all values of these pixels. It is to be noted that each pixel has red (R), green (G), and blue (B) light emitting regions. For each of the pixels, R, G, and B input signals are supplied in configuration. The selective addition unit 2 integrates data related to a blockaded quantity for each of the colors, to obtain and output a sum of results of these integrations for the R, G, and B colors. As for a region not in the vicinity of a spacer, where reflected electrons are not blockaded by the spacer, the resultant sum may be assumed to be 0. A coefficient multiplication unit 4 multiples the summation result by a coefficient (halation gain value) that indicates a percentage by which the summation result is blockaded. The coefficient ordinarily takes on a value between 0 and 1, which is about 1.5% for the panel of the present embodiment. Data output from the coefficient multiplication unit 4 provides a value obtained by calculating quantity reduced by the spacer of halation brightness. As described above, this value is given in condition where image data pieces corresponding to the respective colors are all evaluated.

Figure 8B:
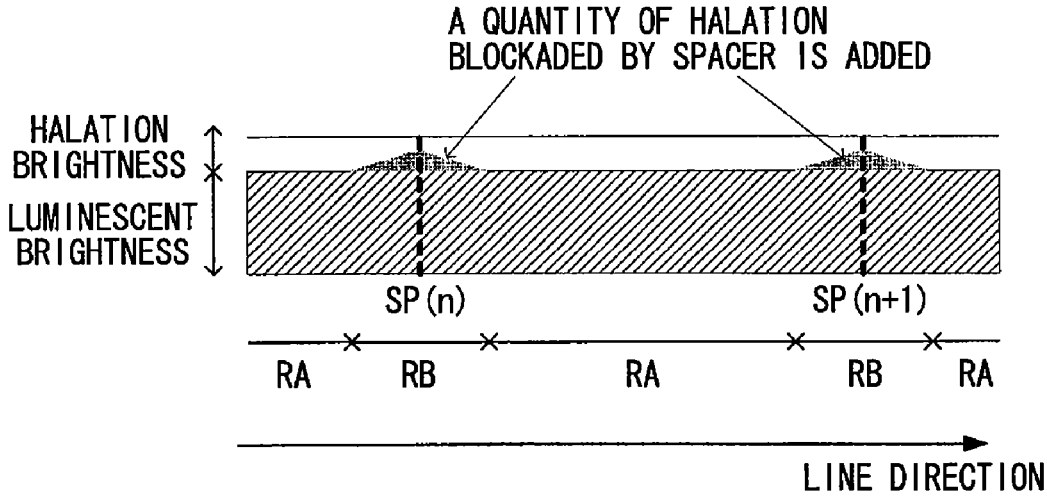

By adding correction data calculated by the coefficient multiplication unit 4 to original image data by using a correction addition unit 6, a correction value equivalent to halation caused by reflected electrons blockaded by the spacer is added to image data in the vicinity of the spacer. If a result of this operation is output as a corrected image, a pre-correction step-wise change in color impurity in the vicinity of the spacer such as shown in FIG. 8A is suppressed to reduce differences in color impurity between a region not in the vicinity of the spacer and a region in the vicinity of the spacer all over an image as shown in FIG. 8B. It is thus possible to correct spacer unevenness is due to halation.

The present inventor observed it by lighting an actual display panel by using the above-described correction method and found that a degrees of correction to reduce differences in color purity between a region not in the vicinity of the spacer and a region in the vicinity of the spacer tends to fluctuate depending on a lighted color. Specifically, it was found that when a G (green) color is lighted, correction is performed so that no differences can be observed in color purity between the region not in the vicinity of the spacer and the region in the vicinity of the spacer, whereas when a R (red) or B (blue) color is lighted, insufficient correction is observed, although differences are reduced in color purity between the region not in the vicinity of the spacer and the region in the vicinity of the spacer.

To counter this problem, in the present embodiment, to R data, G data, and B data (correction-subject data) that correspond to a pixel subject to correction, not the same correction value but correction values adjusted in accordance with the colors are applied. Specifically, the correction values are adjusted by using an adjustment gain multiplication unit 5 to multiply corrected data output from the coefficient multiplication unit 4 by an adjustment gain value that corresponds to each of the R, G, and B colors. By assuming the color-specific correction values obtained by this adjustment to be an R correction value, a G correction value, and a B correction value respectively, corrected image data pieces Rout, Gout, and Bout that correspond to each colors respectively are as follows.

Rout=Rin+R correction value

Gout=Gin+G correction value

Bout=Bin+B correction value

It is to be noted that the R correction value, the G correction value, and the B correction value need not take on different values.

The present inventor checked a tendency of fluctuations in correction quantity for each of color components of the color that was lighted, to come up with a result shown in FIG. 9.

FIG. 9 shows a result of adjustment that was performed on R, G, and B adjustment gain values by the adjustment gain multiplication unit 5 so that a color deviation may be eliminated between a region in the vicinity of a spacer and a region not in the vicinity of the spacer for R, G, and B components of each of lighted colors for seven patterns of R (red), G (green), and B (blue) that were generated independently, Ye (yellow), Cy (cyan), and Mg (magenta) that were given by mixing two colors respectively, and W (white) that was given by mixing the three colors. In this case, to perform visual adjustment by separating the color components from each other, the present inventor used an R color filter to adjust the R component, a G color filter to adjust the G component, and B color filter to adjust the B component. Specifically, to adjust the R component when the B light was lit, the present inventor used the R color filter in condition where the B light was on, to determine such an R adjustment gain value that a difference in color purity between a region not in the vicinity of the spacer and a region in the vicinity of the spacer cannot be recognized visually. To adjust the G component when the B light was lit, the G color filter was used in condition where the B light was on, to determine such a G adjustment gain value that a difference in color purity between the region not in the vicinity of the spacer and the region in the vicinity of the spacer cannot be recognized visually. To adjust the B component when the B light was lit, the B color filter was used in condition where the B light was on, to determine such a B adjustment gain value that a difference in color purity between the region not in the vicinity of the spacer and the region in the vicinity of the spacer cannot be recognized visually.

If the R, G, and B adjustment gain values are 1.0, it means that corrected data system unchanged. A feature is that if R light or B light is lit independently, a quantity of correction on its G component (G correction value) needs to be increased 1.1-fold to 1.4-fold. It was found that attendance of the result of FIG. 9, which was of only one example on a certain display panel, could be seen almost all panels, although fluctuations may be found in value.

Based on this result, such adjustment was performed as to multiply, at the adjustment gain multiplication unit 5, corrected data output from the coefficient multiplication unit 4 by an adjustment gain value corresponding to each of the R, G, and B colors such as, for example, R adjustment gain value=1.0

G adjustment gain value=1.4 (where lighting of B light is accommodated which gives the most conspicuous color deviation due to halation)

B adjustment gain value=1.0, so that a quantity of correction on the G component (G correction value) may be large than a quantity of correction on the R component (R correction value) and a quantity of correction on the B component (B correction value). It was thus possible to reduce insufficient correction that occurred when B light was lit independently in particular.

As described above, in halation correction to reduce spacer unevenness due to halation, if the same quantity of correction is added uniformly to signals of R, G, and B colors, which are original image data, an error in correction may occur such as over-correction or insufficient correction depending on the color lighted. However, by performing adjustment to balance correction quantities as in the present embodiment, a correction error can be reduced. Further, since it is possible to define an increase/decrease in quantity of correction on colors of original data subjected to correction by giving a constant weight to it, the adjustment gain multiplication unit 5 for multiplication of an adjustment ration can be constituted of a simple circuit.

In the above embodiment, a calculation circuit of the present invention is constituted of the line memory 1, the selective addition unit 2, the spacer position information generation unit 3, and the coefficient multiplication unit 4. Further, the adjustment circuit and the correction value addition circuit of the present invention correspond to the adjustment gain multiplication unit 5 and the correction addition unit 6 respectively.

In the above-described embodiment, the present inventor worked out optimal correction conditions for a correction circuit in condition where a display panel was lit under the above-described conditions. It is to be note that the optimal correction conditions are not always the same if specifications of the display panel are different (e.g., a type if electron-emitting device used, a drive voltage, a type of a fluorescent material used, etc.). In such a case, each adjustment gain values for R, G, and B colors corresponding to the adjustment gain multiplication unit 5 can be re-set so that optimal correction conditions may be applied corresponding to a display panel to which the present invention is applied. Further, if numerals shown in FIG. 9 change with fluctuations specific to each display panel, it also possible to acquire an adjustment ratio through the above-described adjustment process so that the adjustment gain values for the R, G, and B colors may be adjusted finely based on this ratio.

Second Embodiment

The first embodiment is featured such a method that, in the vicinity of the spacer, a quantity of reflected electrons blockaded by a spacer is calculated to obtain a correction quantity and this correction quantity is adjusted by using "a predetermined fixed adjustment gain value" for each of colors. This method is effective in a case where a color balance of a correction quantity is adjusted simply. However, in the example if FIG. 9, since a quantity of correction on the G component (G correction value) always takes on a constant increase ratio irrespective of original image data, for example, a G correction value adjusted for R color lighting causes insufficient of a G correction quantity in condition where the B color is lit and, a G correction value adjusted for B color lighting causes over-correction of a G correction quantity in condition where the R color is lit, thereby disabling optimization that matches a lighted color in some cases.

Figure 2:
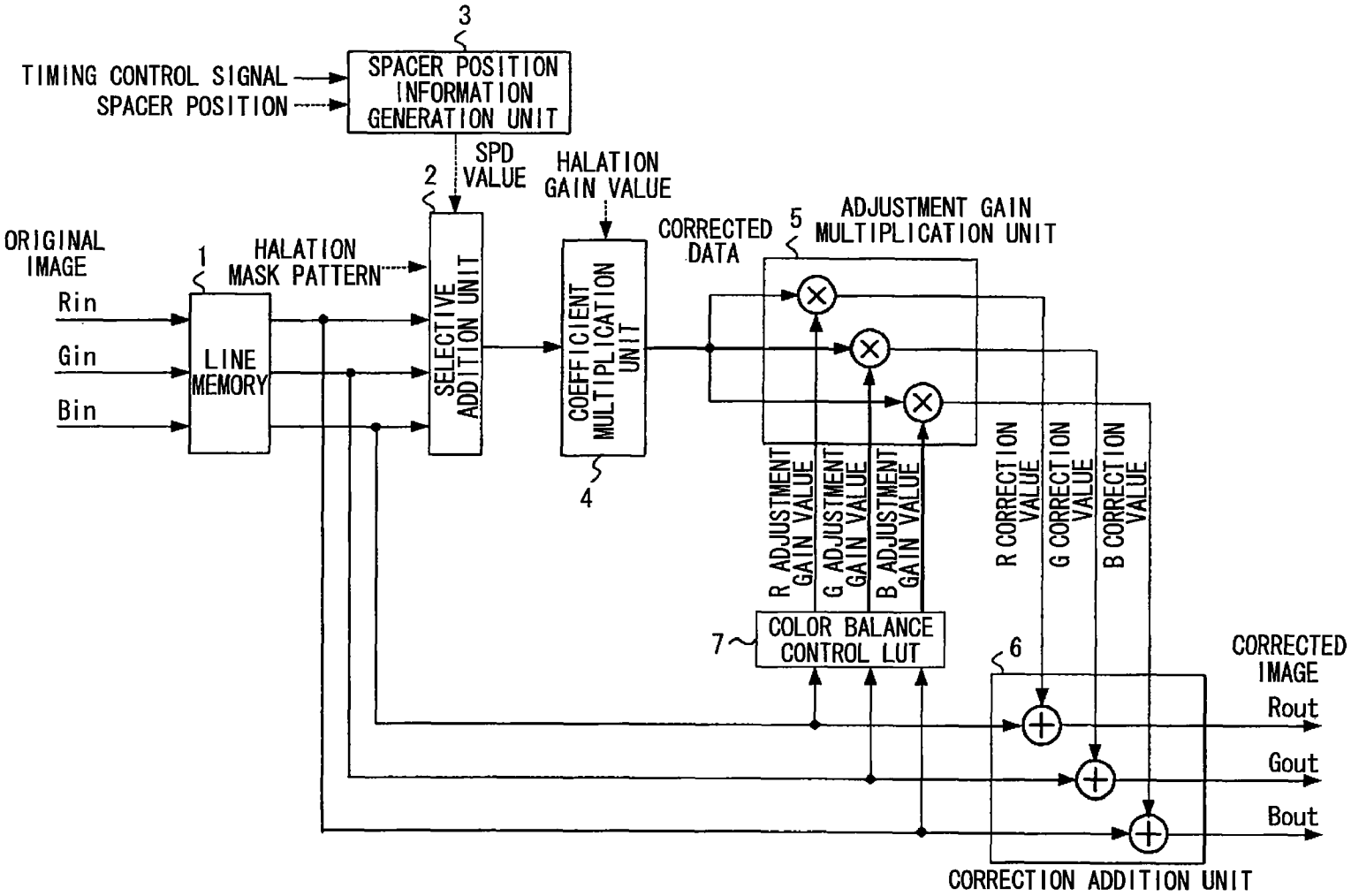
FIG. 2 is a block diagram of a halation correcting unit related to a second embodiment of the present invention.

The following will describe a method for optimizing a quantity of halation addition corresponding to the above-described lighted colors, which is a characteristic point of the present embodiment, with reference to FIG. 2.

Figure 1:
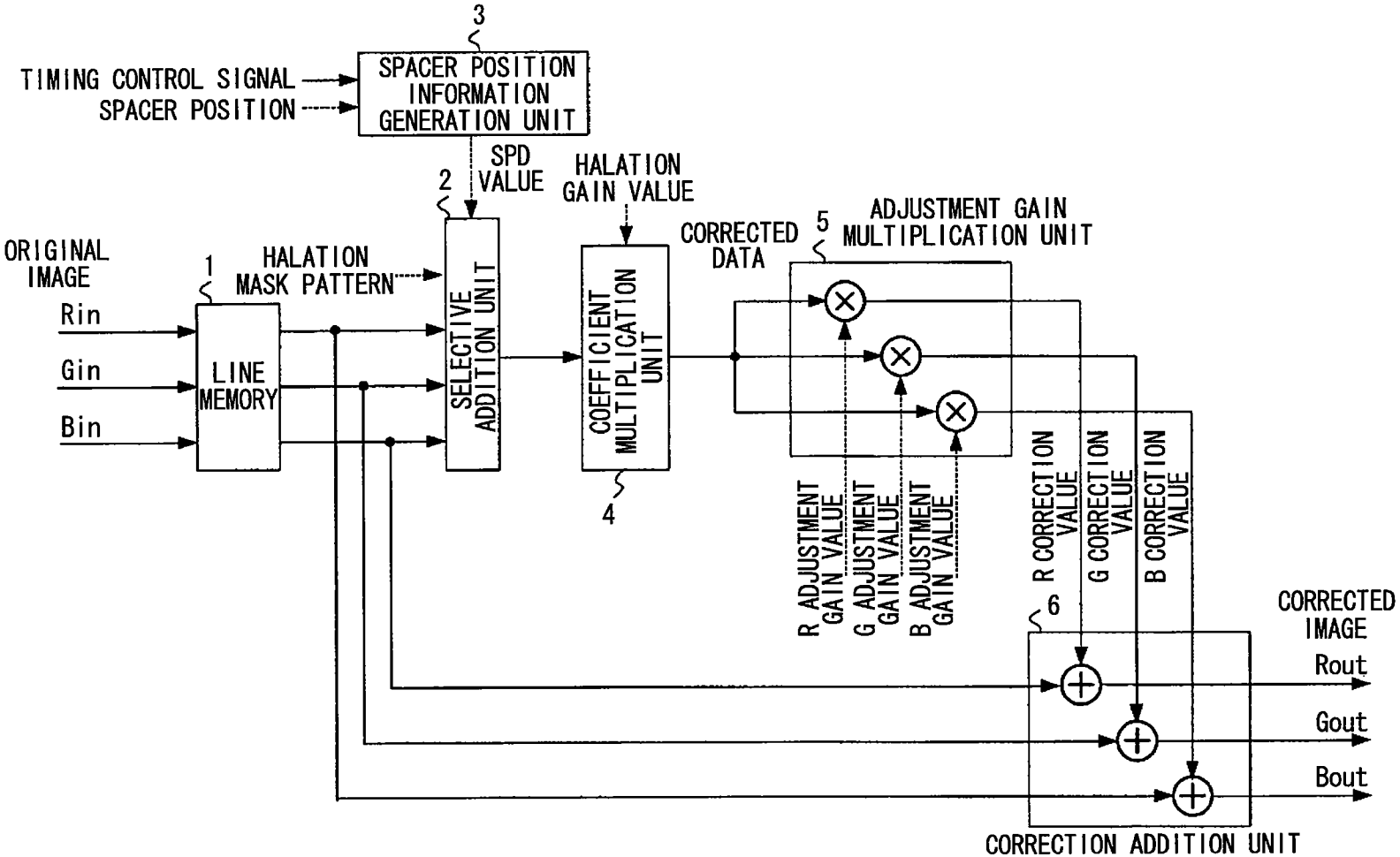
FIG. 1 is a block diagram of a halation correcting unit related to a first embodiment of the present invention.

A halation correction unit of the second embodiment shown in FIG. 2 has the same configuration as that of FIG. 1 except for a color balance control LUT7 added to it. The color balance control LUT7 has, as reference addresses, combinations of all patterns of original image data pieces of R, G, and B colors output from a line memory 1 and stores beforehand R, G, and B adjustment gain values that correspond to these addresses. It is this possible to change an adjustment gain value for each of the colors dynamically according to a lighting pattern of the original image data. The above-described reference table system has a merit of a larger degree of freedom in adjustment and, on the other hand, a demerit of larger memory capacity required to constitute a reference table depending on the number of bits of original image data to be referenced. In such a case, reference bits of the original image data may be decrease to high-order bits to reduce the memory capacity. Then, contents of this reference table may reflect adjustment results shown in FIG. 9 as they are. Although only seven examples of the lighting pattern have been given as the result in FIG. 9 for convenience of explanation, actually the reference table may be enriched in contents through such ad adjustment process as described with the first embodiment depending on combination of lighting patterns referenced by the above-described reference table.

In such a manner, by dynamically changing R, G, and B adjustment gain values for the adjustment gain multiplication unit 5 according to lighted colors, it is possible to optimize a color balance of a quantity of halation addition.

As described above, in the present embodiment, it is possible to finely set an adjustment ratio in accordance with original image data and change the adjustment ratio dynamically. This reduces a correction error remarkably, thereby further improving correction performance.

In the present embodiment, the adjustment gain multiplication unit 5 and the color balance control LUT7 correspond to an adjustment circuit of the present invention.

In the above-described embodiment, the present inventor worked out optimal correction conditions for a correction circuit in condition where a display panel was lit under the above-described conditions. It is to be noted that the optimal correction conditions are not always the same if specifications of the display panel are different (e.g., a type of electron-emitting device used, a drive voltage, a type of a fluorescent material used, etc.). Such as case can be accommodated by requiring the contents of the reference table.

Although the color balance control LUT7 has been described with an example where it is constituted of a reference table using a memory, it may constituted only of logic circuits or constituted of software for a CPU or a medial processor as it is mounted with a mechanism that can change as adjustment ratio for each of the colors according to original image data.

Although in the present embodiment, the color balance control LUT7 and the adjustment gain multiplication unit 5 have been described with reference to such a configuration that they are separated from each other, they may be realized in a configuration that they are combined in one table as far as a mechanism is provided which enables performing arbitrary adjustments (including those for increasing/decreasing) on correction data according to original image data.

Third Embodiment

In the above embodiments, such a configuration has been described as to calculate a correction value that corresponds to a quantity blockaded by a spacer, of an increment in brightness that it to be given by a pixel positioned in the vicinity of a correction-subject pixel to brightness of the correction-subject pixel. The correction value obtained by this calculation is calculated with respect to correction-subject data in such a manner as to increase a value of the correction-subject data.

The present embodiment, on the other hand, employs a configuration to calculate a correction value corresponding to an increment in brightness given by a pixel positioned in the vicinity of a correction-subject pixel to brightness of the correction-subject pixel. In this case, brightness of a correction-subject pixel is corrected on the basis of an obtained correction value so as to decrease by as much as a quantity of brightness given to the correction-subject pixel by a pixel positioned in the vicinity.

The present embodiment employs the same configuration of the halation correction unit as that of FIG. 1. However, it is different from the first and second embodiments in operations of the selective addition unit 2 and the correction addition unit 6.

A case where a correction-subject pixel is distant from a spacer sufficiently and access where it is positioned in the vicinity of the spacer are respectively controlled as follows.

Case where a correction-subject pixel is distant from a spacer sufficiently

If there is no spacer between a correction-subject pixel and pixels (nearby pixels) that can have an influence due to halation on the correction-subject pixel, the correction-subject pixel is influenced by no action of blockading of halation by the spacer. Therefore, a selective addition unit 2 integrates all of data of the nearby pixels (11×11 pixels) and outputs it.

Case where a correction-subject pixel is positioned in the vicinity of a spacer

Data pieces are summed on only those of pixels in the vicinity of a spacer that are positioned on the same side of a correction-subject pixel with respect to the spacer. That is, in contrast to the first and second embodiments where data pieces of pixels placed at positions indicate din gray in FIG. 7 have been integrated, in the present embodiment, data pieces of pixels placed at positions indicated by a white circle within a circle having a halation radius are integrated.

A correction value is calculated by using an integrated value thus obtained, as in the case of the first and second embodiments.

According to a configuration of the present embodiment, an increment in brightness owing to halation is decrease by correction, so that the correction addition unit 6 performs processing to subtract a correction value from correction-subject data.

As may be clear from the above, the present embodiment can be applied also to a configuration using no spacer. In the case of a display panel using no spacer or member corresponding to a spacer, the above-described processing of the case where a correction-subject pixel is sufficiently distant from the spacer may be performed over the entire region.

Although a display apparatus using a surface conduction electron-emitting device has been exemplified, any other display apparatus may encounter cross talk such as halation described above. For example, in a plasma display apparatus, plasma generated by one device may have an influence on brightness of nearby device. Further, in case of a liquid crystal display apparatus or an organic EL display apparatus, a drive voltage applied on one device may have an influence in a drive voltage applied on nearby devices. In these display apparatuses also, cross talk can be corrected much the same way as in the cases of the embodiment described in detail above. It is to be noted that in a transmissive liquid-crystal display apparatus using a backlight or a projecting light source in combination, a light emitting region refers to a region where light passes through. A reflective liquid-crystal display apparatus, on the other hand, a light emitting region refers to a region that reflects light.

This application claims priority from Japanese Patent Applications Nos. 2004-365533 filed Dec. 17, 2004 and 2005-258829 filed Dec. 13, 2005, which are hereby incorporated by reference herein.

What is claimed is:

1. An image display apparatus comprising:

a rear plate having arranged thereon a plurality of electron-emitting devices;

a face plate having arranged thereon a plurality of light-emitting regions, respectively corresponding to the plurality of electron-emitting devices;

a spacer arranged between the rear plate and the face plate; and a drive circuit having a correction circuit which corrects input image data, said drive circuit driving the electron-emitting devices based on the image data corrected by the correction circuit, wherein a quantity of light emitted from an object light-emitting region depends on (i) a quantity of primary electrons coming from a corresponding object electron-emitting device and (ii) a quantity of secondary electrons coming from peripheral light-emitting regions of the object light-emitting region, and the quantity of light emitted from the object light-emitting region decreases when at least some of the secondary electrons coming from the peripheral light-emitting regions are blocked by the spacer, and wherein the correction circuit includes:

a first circuit that calculates, based on a blocked quantity of the secondary electrons coming from the peripheral light emitting regions and blocked by the spacer, a value equivalent to the decrease in the quantity of light emitted from the object light-emitting region, a second circuit that calculates a correction value by multiplying the value equivalent to the decrease in the quantity of light by an adjustment gain value that complies with colors of the object light-emitting region, and a third circuit that adds the correction value to the input image data of corresponding to the object electron-emitting device, so as to reduce a color deviation between a region in the vicinity of the spacer and a region not in the vicinity of the spacer.

2. An image display apparatus according to claim 1, wherein the adjustment gain value for each of the colors is dynamically changed according to a lighting pattern based on the input image data.

3. An image display apparatus according to claim 1, wherein the first circuit includes a line memory and a selective addition unit.

4. An image display apparatus according to claim 3, wherein the first circuit includes a spacer position information generation unit and a coefficient multiplication unit.

5. An image display apparatus comprising:

a rear plate having arranged thereon a plurality of electron-emitting devices;

a face plate having arranged thereon a plurality of light-emitting regions, respectively corresponding to the plurality of electron-emitting devices;

a spacer arranged between the rear plate and the face plate; and a drive circuit having a correction circuit which corrects input image data, said drive circuit driving the electron-emitting devices based on the image data corrected by the correction circuit, wherein a quantity of light emitted from an object light-emitting region depends on (i) a quantity of primary electrons coming from a corresponding object electron-emitting device and (ii) a quantity of secondary electrons coming from peripheral light-emitting regions of the object light-emitting region, and wherein the correction circuit includes:

a first circuit that calculates a value equivalent to a decrease in the quantity of light emitted from the object light-emitting region based on a quantity of secondary electrons coming from the peripheral light-emitting regions and blocked by the spacer, a second circuit that calculates a correction value by multiplying the value equivalent to the decrease in the quantity of light by an adjustment gain value that complies with colors of the object light-emitting region, and a third circuit that adds the correction value to the input image data corresponding to the object electron-emitting device.

6. An image display apparatus according to claim 5, wherein the adjustment gain value for each of the colors is dynamically changed according to a lighting pattern based on the input image data.

7. An image display apparatus according to claim 5, wherein the first circuit includes a line memory and a selective addition unit.

8. An image display apparatus according to claim 7, wherein the first circuit includes a spacer position information generation unit and a coefficient multiplication unit.

* * * * *